US009907438B2

(12) United States Patent
Ross

(10) Patent No.: US 9,907,438 B2
(45) Date of Patent: Mar. 6, 2018

(54) SPLASH GUARD

(71) Applicant: The Splash Baby LLC, Gainesville, GA (US)

(72) Inventor: Jessica Ann Ross, Gainesville, GA (US)

( * ) Notice: Subject to any disclaimer, the term of this patent is extended or adjusted under 35 U.S.C. 154(b) by 0 days.

(21) Appl. No.: 15/386,051

(22) Filed: Dec. 21, 2016

(65) Prior Publication Data

US 2017/0172354 A1 Jun. 22, 2017

Related U.S. Application Data

(60) Provisional application No. 62/270,712, filed on Dec. 22, 2015.

(51) Int. Cl.

| | |
|---|---|
| ***A47K 3/00*** | (2006.01) |
| ***A47K 3/30*** | (2006.01) |
| ***A47K 3/38*** | (2006.01) |

(52) U.S. Cl.

CPC ..... *A47K 3/302* (2013.01); *A47K 3/001* (2013.01); *A47K 3/38* (2013.01)

(58) Field of Classification Search

CPC ..... A47K 3/302; A47K 3/38; A47K 3/001
USPC ..... 4/609
See application file for complete search history.

(56) References Cited

U.S. PATENT DOCUMENTS

| | | | | |
|---|---|---|---|---|
| 2,725,576 | A | 12/1955 | Schwersinske | |
| 5,249,315 | A | 10/1993 | Moylan | |
| 6,341,388 | B1 | 1/2002 | Roberts | |
| 6,701,543 | B1 | 3/2004 | Haq | |
| 7,328,466 | B1 * | 2/2008 | Bowen | A47K 3/302 160/23.1 |
| D679,232 | S | 4/2013 | Thomas | |
| 2004/0231045 | A1 | 11/2004 | Carter | |
| 2011/0258768 | A1 | 10/2011 | Spingola et al. | |
| 2016/0265275 | A1 * | 9/2016 | Rosell Rosell | A47K 3/38 |

* cited by examiner

*Primary Examiner* — Huyen Le
(74) *Attorney, Agent, or Firm* — Ballard Spahr LLP

(57) ABSTRACT

An article for use in a water receiving structure is disclosed. The article is directed to keeping water inside a water receiving member and preventing water splash and water damage to adjacent surfaces.

20 Claims, 9 Drawing Sheets

SPLASH GUARD

CROSS-REFERENCE TO RELATED APPLICATIONS

This application is a U.S. non-provisional application claiming the benefit U.S. provisional Application No. 62/270,712, filed Dec. 22, 2015, which is incorporated herein fully by this reference.

FIELD OF INVENTION

This invention relates to a removable splash guard for preventing water splashing during the use of water receiving articles.

BACKGROUND

Kids of all ages enjoy a bath time; especially they enjoy the opportunity to play in the bathtub and use the time to splash around in the water and/or to play with toys. Playtime in a bathtub can in many cases result in large volumes of water being splashed on a supervising caregiver or onto the floor or other adjacent surfaces. Excess water on a floor can result in hazardously slick conditions for children and caregivers alike. Furthermore, excess water on a floor and other adjacent surfaces can also result in water damage to these surfaces or a possible growth of mold and bacteria that can also affect the health of children and caregivers alike.

Thus, there is a need for articles and methods of using the same to prevent water splash and protect adjacent surfaces from the water damage, while providing adequate visibility for the caregivers.

SUMMARY

Disclosed herein is an article comprising: a) a protective member dispenser comprising an upper edge and an open lower edge and a side extending between the upper and lower edge, wherein the protective member dispenser comprises a protective member, which during use is dispensed and comprises: i) a central axis and a transverse axis that is perpendicular to the central axis, ii) a first width defined by a top edge and a bottom edge spaced apart relative to the central axis, iii) a first length defined by a first side edge and a second side edge extending between the top edge and the bottom edge, wherein the first side edge and a second side edge are spaced apart relative to the transverse axis, wherein the first side edge is secured within the protective member dispenser, b) one or more first removable attachment members attached to the side of the protective member dispenser, c) one or more second removable attachment members located along the second side edge, wherein at least a first upper portion of the protective member comprising the top edge is configured to be situated above a top edge of a water receiving structure, thereby preventing water from splashing over the top edge of the water receiving structure and wherein the at least the first upper portion forms a first upper side edge and a second upper side edge; and wherein at least a first lower portion of the protective member comprising the bottom edge is configured to extend beyond the open lower edge of the protective member dispenser and be situated inside of the water receiving structure, thereby allowing water running downwards from the first upper portion to return back to the water receiving structure and wherein the at least the first lower portion forms a first lower side edge and a second lower side edge.

Also disclosed herein is an article comprising: a) a protective member comprising: i) a central axis and a transverse axis that is perpendicular to the central axis, ii) a first width defined by a top edge and a bottom edge spaced apart relative to the central axis, and iii) a first length defined by a first side edge and a second side edge extending between the top edge and the bottom edge, wherein the first side edge and a second side edge are spaced apart relative to the transverse axis; b) one or more first removable attachment members located along the first removable attachment member located along the first side edge, and c) one or more second removable attachment members located along the second side edge, wherein at least a first upper portion of the protective member comprising the top edge is configured to be situated above a top edge of a water receiving structure, thereby preventing water from splashing over the top edge of the water receiving structure and wherein at least the first upper portion forms a first upper side edge and a second upper side edge; and wherein at least a first lower portion of the protective member comprising the bottom edge is configured to be situated inside of the water receiving structure, thereby allowing water running downwards from the first upper portion to return back to the water receiving structure and wherein the at least the first lower portion forms a first lower side edge and a second lower side edge.

Also disclosed herein is an article comprising: a) a protective member dispenser comprising an upper edge and an open lower edge and a side extending between the upper and lower edge, wherein the protective member dispenser comprises a first support bar being parallel to the side of the protective member dispenser extending between the upper and lower edge, wherein the protective member dispenser comprises a protective member, which during use is dispensed and comprises: i) a central axis and a transverse axis that is perpendicular to the central axis, ii) a first width defined by a top edge and a bottom edge spaced apart relative to the central axis, iii) a first length defined by a first side edge and a second side edge extending between the top edge and the bottom edge, wherein the first side edge and a second side edge are spaced apart relative to the transverse axis, wherein the first side edge is at least partially secured to the protective member dispenser, b) one or more first removable attachment members attached to the first support bar, c) one or more second removable attachment members located along the second side edge or one or more second removable attachment members attached to a second support bar secured to the second side edge, wherein at least a first upper portion of the protective member comprising the top edge is configured to be situated above a top edge of a water receiving structure, thereby preventing water from splashing over the top edge of the water receiving structure and wherein the at least the first upper portion forms a first upper side edge and a second upper side edge; and wherein at least a first lower portion of the protective member comprising the bottom edge is configured to extend beyond the open lower edge of the protective member dispenser and be situated inside of the water receiving structure, thereby allowing water running downwards from the first upper portion to return back to the water receiving structure and wherein the at least the first lower portion forms a first lower side edge and a second lower side edge.

Additional advantages will be set forth in part in the description which follows, and in part will be obvious from the description, or may be learned by practice of the aspects described below. The advantages described below will be realized and attained by means of the elements and combinations particularly pointed out in the appended claims. It is to be understood that both the foregoing general description and the following detailed description are exemplary and explanatory only and are not restrictive.

BRIEF DESCRIPTION OF THE FIGURES

These and other features of the preferred embodiments of the invention will become more apparent in the detailed description in which reference is made to the appended drawings wherein.

Figure 1:
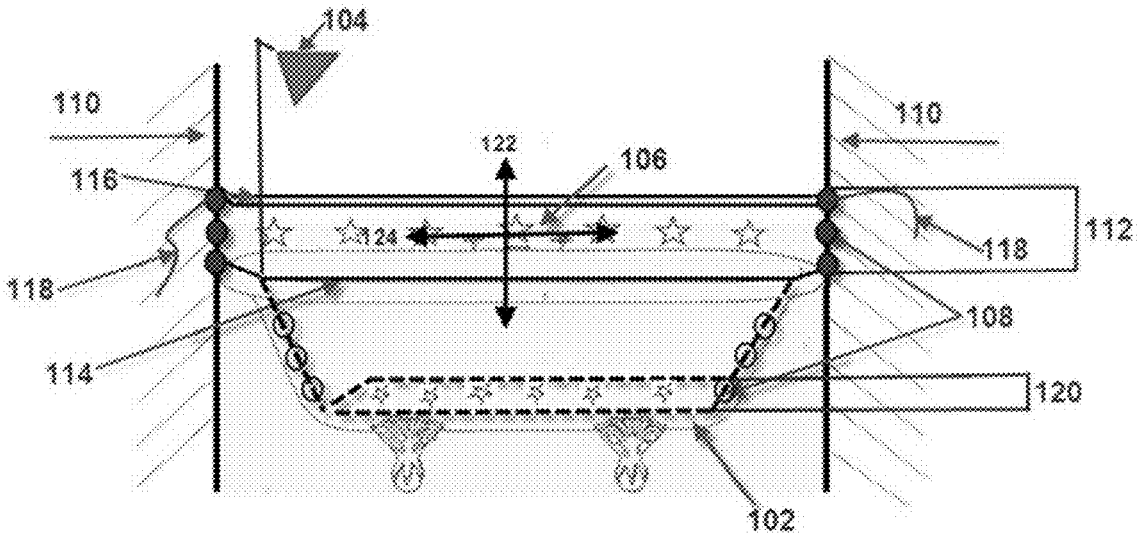
FIG. 1 shows an exemplary article disclosed herein positioned in a water-receiving member.

Additional advantages of the invention will be set forth in part in the description which follows, and in part will be obvious from the description, or can be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION

The present invention can be understood more readily by reference to the following detailed description, examples, drawings, and claims, and their previous and following description. However, before the present articles, devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

A. DEFINITIONS

Various combinations of elements of this disclosure are encompassed by this invention, e.g. combinations of elements from dependent claims that depend upon the same independent claim.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification It is also to be understood that the terminology used herein is for the purpose of describing particular aspects only and is not intended to be limiting. As used in the specification and in the claims, the term "comprising" may include the aspects "consisting of" and "consisting essentially of" Unless defined otherwise, all technical and scientific terms used herein have the same meaning as commonly understood by one of ordinary skill in the art to which this invention belongs. In this specification and in the claims which follow, reference will be made to a number of terms which shall be defined herein. As used throughout, the singular forms "a," "an" and "the" include plural referents unless the context clearly dictates otherwise. Thus, for example, reference to "a suction cup" can include two or more such suction cups unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

B. SPLASH GUARD

To reduce the risk of injury, or excessive water splash out of a water receiving structure, such as a bathtub, parents or guardians will sometimes close the shower curtain while a child is bathing. This can create a risk of drowning or other injury due to the limited visibility behind the curtain. A splash guard placed along the edge of a water receiving structure can solve this problem by allowing the supervisor to remain in a clear sight of a bathing child, while providing an extended deflecting surface for keeping water in a water receiving structure.

In one aspect, disclosed herein is an article comprising: a) a protective member dispenser comprising an upper edge and an open lower edge and a side extending between the upper and lower edge, wherein the protective member dispenser comprises a protective member, which during use is dispensed and comprises: i) a central axis and a transverse axis that is perpendicular to the central axis, ii) a first width defined by a top edge and a bottom edge spaced apart relative to the central axis, iii) a first length defined by a first side edge and a second side edge extending between the top edge and the bottom edge, wherein the first side edge and a second side edge are spaced apart relative to the transverse axis, wherein the first side edge is secured within the protective member dispenser, b) one or more first removable attachment members attached to the side of the protective member dispenser, c) one or more second removable attachment members located along the second side edge, wherein at least a first upper portion of the protective member comprising the top edge is configured to be situated above a top edge of a water receiving structure, thereby preventing water from splashing over the top edge of the water receiving structure and wherein the at least the first upper portion forms a first upper side edge and a second upper side edge; and wherein at least a first lower portion of the protective member comprising the bottom edge is configured to extend beyond the open lower edge of the protective member dispenser and be situated inside of the water receiving structure, thereby allowing water running downwards from the first upper portion to return back to the water receiving structure and wherein the at least the first lower portion forms a first lower side edge and a second lower side edge.

In one aspect, also disclosed herein is an article comprising: a) a protective member comprising: i) a central axis and a transverse axis that is perpendicular to the central axis, ii) a first width defined by a top edge and a bottom edge spaced apart relative to the central axis, and iii) a first length defined by a first side edge and a second side edge extending between the top edge and the bottom edge, wherein the first side edge and a second side edge are spaced apart relative to the transverse axis; b) one or more first removable attachment members located along the first removable attachment member located along the first side edge, and c) one or more second removable attachment members located along the second side edge, wherein at least a first upper portion of the protective member comprising the top edge is configured to be situated above a top edge of a water receiving structure, thereby preventing water from splashing over the top edge of the water receiving structure and wherein at least the first upper portion forms a first upper side edge and a second upper side edge; and wherein at least a first lower portion of the protective member comprising the bottom edge is configured to be situated inside of the water receiving structure, thereby allowing water running downwards from the first upper portion to return back to the water receiving structure and wherein the at least the first lower portion forms a first lower side edge and a second lower side edge.

In one aspect, also disclosed herein is an article comprising: a) a protective member dispenser comprising an upper edge and an open lower edge and a side extending between the upper and lower edge, wherein the protective member dispenser comprises a first support bar being parallel to the side of the protective member dispenser extending between the upper and lower edge, wherein the protective member dispenser comprises a protective member, which during use is dispensed and comprises: i) a central axis and a transverse axis that is perpendicular to the central axis, ii) a first width defined by a top edge and a bottom edge spaced apart relative to the central axis, iii) a first length defined by a first side edge and a second side edge extending between the top edge and the bottom edge, wherein the first side edge and a second side edge are spaced apart relative to the transverse axis, wherein the first side edge is at least partially secured to the protective member dispenser, b) one or more first removable attachment members attached to the first support bar, c) one or more second removable attachment members located along the second side edge or one or more second removable attachment members attached to a second support bar secured to the second side edge, wherein at least a first upper portion of the protective member comprising the top edge is configured to be situated above a top edge of a water receiving structure, thereby preventing water from splashing over the top edge of the water receiving structure and wherein the at least the first upper portion forms a first upper side edge and a second upper side edge; and wherein at least a first lower portion of the protective member comprising the bottom edge is configured to extend beyond the open lower edge of the protective member dispenser and be situated inside of the water receiving structure, thereby allowing water running downwards from the first upper portion to return back to the water receiving structure and wherein the at least the first lower portion forms a first lower side edge and a second lower side edge.

In one aspect, the first support bar can be secured to at least the upper edge of the protective member dispenser. In another aspect, the first support bar can be secured to at least the upper edge and the open lower edge of the protective member dispenser. In yet another aspect, the first support bar can be secured to the protective member housing.

In one aspect, the article comprises the first support bar and the second support bar.

In one aspect, the one or more first removable attachment members are attached to a bottom edge of the first support bar. As such, the article can be secured to stand upright on the water receiving structure, for example, stand upright on a bathtub. Thus, the article does not need to be secured to a wall. In another aspect, the one or more first removable attachment members are attached to a bottom edge of the first support bar, and the one or more second removable attachment members are attached to a bottom edge of the second support bar. As such, the article can be secured to stand upright on the water receiving structure, for example, stand upright on a bathtub and the second support bar can also be secured stand upright on the water receiving structure, for example, a bathtub.

In one aspect, the first support bar is made of metal, such as steel, or a hard plastic. In one aspect, the second support bar is made of metal, such as steel, or a hard plastic.

In the aspects described herein, the water receiving structure can be any structure capable of receiving water. In some aspects, the water receiving structure comprises a shower structure, a tub structure, a pool structure, or any combination thereof. In some aspects, the water receiving structure is a shower structure. In other aspects, the water receiving structure is a tub structure. In some aspects, the tub structure can comprise a showerhead. In yet other aspects, the tub structure can be without a showerhead. In yet other aspects, the water receiving structure is a pool structure. In still further aspects, the water receiving structure is a sink structure. In some aspects, the water receiving structure can further comprise one or more jet members providing a water jet. In yet other aspects, the water receiving structure can comprise a pressure system providing water to the jet members. It is understood that the water receiving structure can be adjacent to a surface. In some aspects, the adjacent surfaces are sidewalls that the water receiving structure is connected to. In some aspects, the article described herein is attached to the adjacent surfaces of the water receiving structure. In other aspects, the adjacent surfaces can comprise any materials known in the art, for example and without limitation, the adjacent surfaces such as the adjacent sidewalls can comprise a mirror, a glass, a ceramics, a concrete, a brick, a wood, a plastic material, a marble, a stone, a linoleum, metal finishes, a granite, and any combination thereof.

In some aspects, a water receiving structure has a top edge and a bottom edge. It is understood that the article described herein prevents water from splashing over the top edge of the water receiving structure. It is further understood that the article described herein allows splashed water to be returned back to the water receiving structure and not to be disposed on a floor or adjacent surfaces. In some aspects, where the water receiving structure is a shower structure, the top edge of the water receiving structure is a bottom rim of the shower structure. In yet other aspects, where the water receiving structure is a tub, the top edge of the water receiving structure is a tub rim. In yet other aspects, where the water receiving structure is a pool, the top edge of the water receiving structure is a pool rim. In still further aspects, where the water receiving structure is a sink, the top edge of the water receiving structure is a sink rim.

In certain aspects, the at least a first upper portion of the protective member comprising the top edge and that is configured to be situated above the top edge of water receiving structure has a second width. In other aspects, the at least a first lower portion of the protective member comprising the bottom edge and that is configured to be situated inside of the water receiving structure has a third width. It is understood that the second width of the protective member can be easily adjusted by a caregiver depending on the age and/or height of the child, amount of splashed water, and/or required visibility. It is further understood that the second and third widths are interconnected. The increase in the second width can result in the decrease in the third width.

In one aspect, the protective member dispenser further comprises a water receiving support structure that is configured extend horizontally from the protective member dispenser and be placed on the top edge of water receiving structure, thereby providing stability to the article. In another aspect, the protective member housing further comprises a water receiving support structure that is configured extend horizontally from the protective member dispenser and be placed on the top edge of water receiving structure, thereby providing stability to the article.

In aspects where the article comprises a protective member dispenser, the protective member extends beyond the open lower edge of the protective member dispenser. In one aspect, the protective member extends from about 1 to about 15 inches beyond the open lower edge of the protective member dispenser. In another aspect, the protective member can extend from about 2 to about 6 inches beyond the open lower edge of the protective member dispenser. As such, the portion of the protective member that extends beyond the open lower edge of the protective member dispenser is configured to be situated inside of the water receiving structure.

In one aspect, the first width defined by a top edge and a bottom edge of the protective member spaced apart relative to the central axis is from about 10 inches to about 60 inches. For example, the first width defined by a top edge and a bottom edge of the protective member spaced apart relative to the central axis is from about 15 inches to about 40 inches.

In some aspects, the second and the third width can be the same or different. In one aspect, the second width is substantially equal to the third width. In another aspect, the second width can be from about 1 to about 40 inches, including exemplary values of about 2 inches, about 5 inches, about 10 inches, about 15 inches, about 20 inches, about 25 inches, about 30 inches, and about 35 inches. In yet other aspects, the second width can be any value between any two foregoing points. In certain aspects, the third width can be from about 1 to about 40 inches, including exemplary values of about 2 inches, about 5 inches, about 10 inches, about 15 inches, about 20 inches, about 25 inches, about 30 inches, and about 35 inches. In yet other aspects, the third width can be any value between any two foregoing points. It is further understood that in some aspects, the second and third width can be determined by one of ordinary skill in the art based on a type of the water receiving structure. Specifically, it is understood that in certain aspects, the second and third width can be any value depending on a height of the top and bottom edge of the water receiving structure. It is further understood that the second and third width can be any value that allows one of ordinary skill in the art to prevent splashing of water on a floor or adjacent to the water receiving structure surfaces. In yet other aspects, it is understood that the second and third width can be any value that allows splashed water to be returned back to the water receiving structure. In yet other aspects, the second width can be from about 1 to about 40 inches and the third width from about 1 and about 40 inches. It is understood that the second and third width can be interconnected.

In some aspects, the one or more first and/or second removable attachment members are located along the first and second edge of the protective member and are configured to be attached to adjacent surfaces of the water receiving structure. In some aspects, the adjacent surfaces comprise adjacent sidewalls of the water receiving structure. In some aspects, the adjacent sidewalls can comprise one or more a mirror, a glass, a ceramics, a concrete, a brick, a wood, a plastic material, a marble, a stone, a linoleum, metal finishes, a granite and the like. In yet other aspects, the adjacent surfaces can be colored or textured. In some aspects, the one or more first and/or second removable attachment members are located along the first and second upper side edges. In some aspects, the first and/or second removable attachment members can comprise at least two removable attachment members. In other aspects, the first and/or second removable attachment members can comprise at least three removable attachment members. In yet other aspects, the first and/or second removable attachment member can comprise from at least 2 to about 30 removable attachment members, including exemplary 3, 5, 8, 10, 12, 15, 18, 20, 23, 25, and 28 removable attachment members. In yet other aspects, and as readily appreciated by one of ordinary skills in the art, a number of the first and/or second removable members can be any number that allows a safe and convenient attachment of the protective member to the adjacent surfaces and provides a desirable splash protection. It is understood that the one or more first and/or second removable attachment members can be spaced from each to another at any distance.

In one aspect, the first removable attachment members can be configured to be extendible from the protective member dispenser. In another aspect, the first removable attachment members can be configured to be extendible from the protective member housing. Such an arrangement can allow the protective member dispenser and/or protective member housing to be position within the water receiving structure and a portion of the protective member dispenser and/or protective member can be positioned below the top edge of the water receiving structure, while the first removable attachment members can extend to and be attached to the side wall of the water receiving structure.

In yet other aspects, the protective member can further comprise one or more third removable attachment members located along the bottom edge of the protective member. In still further aspects, the one or more third removable attachment members placed along the bottom edge of the protective member can be attached to an adjacent part of the water receiving structure. It is understood that if the one or more third removable attachment members are present and secured to the adjacent part of the water receiving structure, this configuration will assist in a splash water from the first upper portion to run downwards of the water receiving structure. In some aspect, this configuration can substantially secure the at least first lower portion of the protective member within the water receiving structure. In some aspects, the removable attachment member comprises at least two members. In yet other aspects, the removable attachment member comprises at least three members. In yet other aspects, the third removable attachment member can comprise from at least 2 to about 30 removable attachment members, including exemplary 3, 5, 8, 10, 12, 15, 18, 20, 23, 25, and 28 removable attachment members. It is further understood that a number of the third removable attachment members can be any number allowing a secure attachment of the bottom edge of the protective member to the bottom part of the water receiving structure. It is also understood that the one or more third attachment members can be located at any distance from each other.

In some aspects, the protective member can further comprises one or more fourth removable attachment members located on the protective member. In some aspects, the one or more fourth removable attachment members can be located substantially in the center of the protective member. It is understood that the one or more fourth removable attachment members can be located anywhere on the protective member.

In some aspects, the one or more first, second, third or fourth removable attachment members are placed to form a design pattern. In other aspects, the one or more first, second, third or fourth removable attachment members are placed randomly.

In some aspects the one or more first, second, third and fourth removable attachment members are a same type of an attachment member or a different type of an attachment member. In some aspects, the one or more first, second, third or fourth removable attachment members can comprise a suction cup, a hook, a latch, or a ring. The suction cup, hook, latch, or ring can be made of any suitable material, such as, for example, rubber, plastic, or metal. In yet other aspects, the one or more first, second, third or fourth removable attachment members can comprise any water resistant adhesive. In the aspects, where the one or more first, second, third or fourth removable attachment members comprise a water resistant adhesive, the water resistant adhesive can be reapplied to secure the protective member in a water receiving structure. In other aspects, the water resistant adhesive does not need to be reapplied to secure the protective member in a water receiving structure. In some aspects, the water resistant adhesive can be reused multiple times.

It is understood that the protective member can be made of any materials able to withstand or repel water. In some aspects, the protective member can be a plastic material. In certain aspects, the protective member can be a foldable plastic material. In other aspects, the protective member can be a rigid plastic material. In some aspects, the plastic material can comprise a vinyl, a polyethylene, or a polypropylene. In yet other aspects, the plastic material is a vinyl. In yet other aspects, the protective member can be transparent or translucent. In certain aspects, the protective member is transparent. In some aspects, the protective member can comprise a decorative pattern. It is understood that the protective member can have any decorative patterns, for example and without limitation, patterns related to the book or film characters, animals, toys, or nature. It is further understood that the protective member can be colored.

In certain aspects, the protective member can be foldable and can be configured to have an adjustable length. As one of ordinary skill in the art would readily appreciate, the size of the water receiving structure can vary. The protective member of the current invention allows flexibility for a user to utilize the same protective member for a large variety of the different water receiving structures. In some aspects, the first length of the protective member is configured to extend. In other aspects, the first length of the protective member is configured to extend to a second length, wherein the second length corresponds to a distance between the adjacent sidewalls of the water receiving structure. In yet other aspects, the second length corresponds to a distance between the adjacent surfaces of the water receiving structure. In yet other aspects, the first length can be configured to contract. In still further aspects, the first length is configured to contract to a third length, wherein the third length corresponds to a distance between the adjacent sidewalls of the water receiving structure. In yet other aspects, the third length corresponds to a distance between the adjacent surfaces of the water receiving structure. It is understood that the second and the third length can be same or different. In yet other aspects, the second length is different from the third length.

It is understood that the extension or contraction of the first length can be accomplished by any methods known in the art. In some aspects, the top edge of the protective member can comprise a first extension member allowing extending the first length to the second length. In yet other aspects, the top edge of the protective member can comprise a first extension member allowing contracting the first length to the third length. In yet other aspects, the top edge of the protective member can comprise a first extension member allowing to extend the first length to the second length and/or to contract the first length to the third length.

In yet other aspects, the bottom edge of the protective member can comprises a second extension member first extension member allowing extending the first length to the second length. In yet other aspects, the bottom edge of the protective member can comprise a second extension member allowing contraction the first length to the third length. In yet other aspects, the bottom edge of the protective member can comprise a second extension member allowing the first length to extend to the second length and/or to contract the first length to the third length.

In certain aspects, at least a third portion of the protective member can be folded relative to the transverse axis of the protective member to form a folded structure having a fourth length. In yet other aspects, the folded structure can be attached to at least a fourth portion of the protective member having a fifth length with one or more fifth attachment members. It is understood that the folded structure allows the protective member to extend to the fourth length when unfolded. It is further understood that in some aspects the fifth length can be substantially similar to the first length. It is further understood that the one or more fifth attachment members are utilized to keep the folded structure attached to the at least a fourth portion of the protective member when there is no need to extend the length of the protective member. It is further understood that the folded structure can be configured to keep the esthetics of the protective member and to not interfere with the protection against splashed water.

In one aspect, the first length can be from about 40 inches to about 80 inches. For example, the first length can be from about 55 inches to about 70 inches.

In certain aspects of the current invention, the one or more of fifth attachment members are located anywhere on the folded structure and anywhere on the at least a fourth portion of the protective member. It is further understood that the fourth length can be any length configured to fit the dimensions of the water receiving structure. In some aspects, the one or more of fifth attachment members can comprise a fastener. In some aspects, the fastener can comprise a snapping fastener, a locking fastener, an adhesive fastener, a magnet or any combination thereof. In some aspects, the fastener comprises a water resistant material. In yet other aspects, the one or more fifth attachment members comprise a coupled fastener. In these aspects, the coupled fastener comprises a female and a male member. The female and male member are attached to secure the folded structure on the at least a fourth portion of the protective member. In one aspect, the female member of the fastener is positioned on the at least a fourth portion of the protective member. In yet other aspect, the male member of the fastener is positioned on the folded structure. In still further aspects, the female member of the fastener is positioned on the folded structure, and the male member of the fastener is positioned on the at least a fourth portion of the protective member.

In still further aspects, the top edge of the protective member can comprise a first extension member and the bottom edge of the protective member can comprise a second extension member. It is further understood that the first and second extension members can be configured to fit a variety of the water receiving structures. In some aspects, the first and second extension members can have a same size or a different size. In yet other aspects, the first and second extension members can be a same type extension member or a different type extension member. In still further aspects, the first and the second extension members are the same type extension members. In certain aspects, the first and second extension members can comprise any material allowing extension or contraction of the protective member. In some aspects, the first and/or second extension member can comprise an elastic material. In yet other aspects, the first and/or second extension member can comprise a cord. In certain aspects, the cord can comprise a textile, a plastic, or metal material.

Exemplary articles positioned in an exemplary receiving water structure is shown in FIGS. 1-7. In FIG. 1, the receiving water structure is a bathtub 102 with a showerhead 104. The protective member 106 having a design pattern printed on the surface is secured with the removable attachment members, such as suction cups 108 to the bathtub adjacent sidewalls 110. The first upper portion 112 of the protective member 106 having a second width of about 2-4 inches is extending above a bathtub rim 114, thereby preventing water from splashing over the bathtub rim. The top edge 116 of the protective member 106 comprises an extension member 118, for example, an elastic cord that can be extended or contracted depending on the size of the water receiving structure. The first lower portion 120 of the protective member 106 having a third width of about 2-4 inches is situated inside the bathtub 102 thereby allowing water running downwards from the first upper portion 112 to return back to the bathtub. FIG. 1 also shows the central axis 122 and a transverse axis 124.

Figure 2:
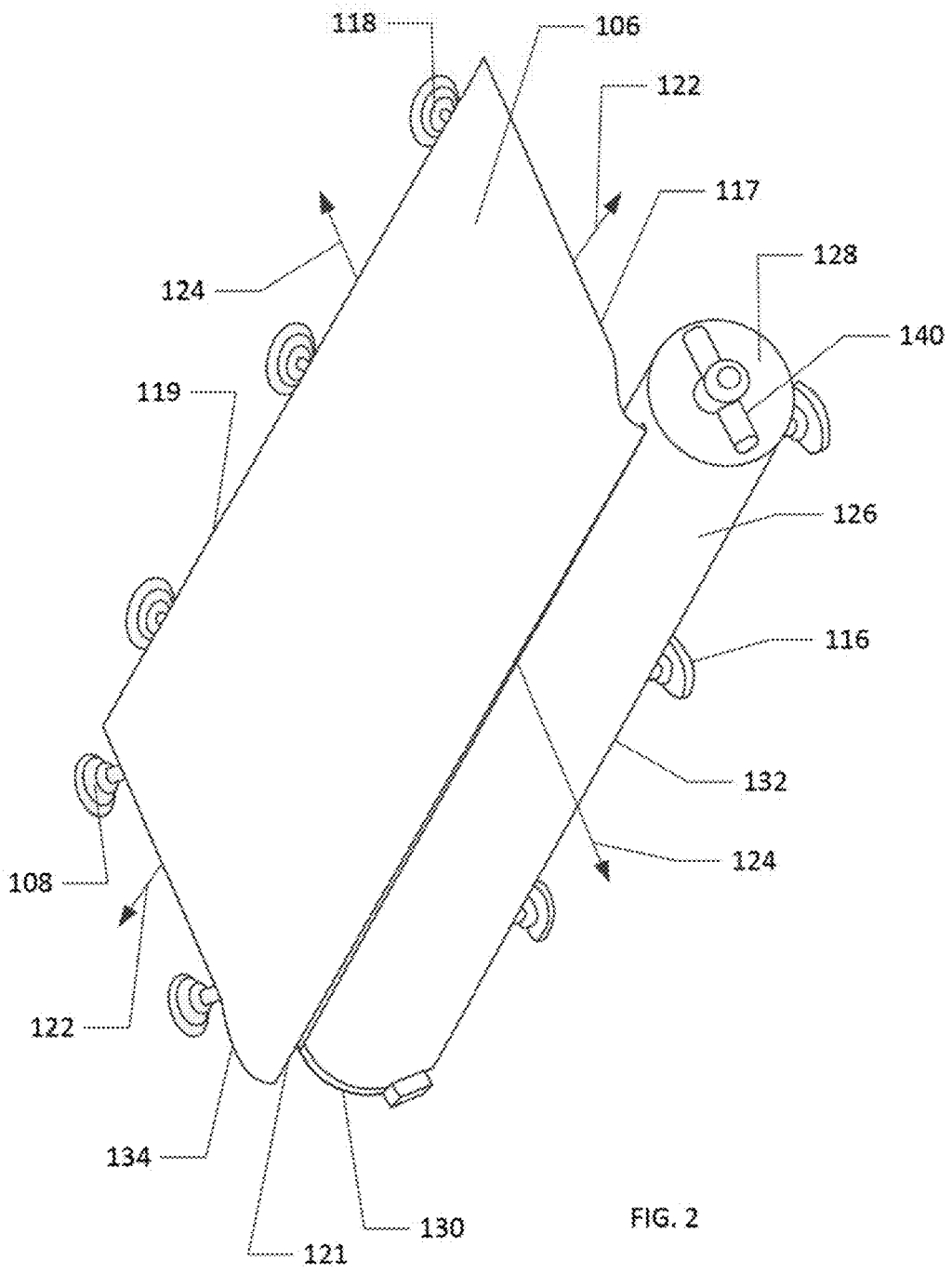
FIG. 2 shows an exemplary article disclosed herein.

FIG. 2 shows another exemplary article disclosed herein. The article has a protective member dispenser 126. The protective member dispenser 126 can have a protective member housing that contains the protective member 106. The protective member dispenser 126 can also be without a protective member housing, wherein the protective member 106 is rolled up on the protective member dispenser 126 from where the protective member 106 can be dispensed. The protective member dispenser 126 has an upper edge 128 and an open lower edge 130. A portion of the protective member 106 having the bottom edge 134 extends beyond the open lower edge 130. The lower edge 130 is open to allow for the protective member 106 to extend beyond the open lower edge 130. The protective member dispenser 126 has a side 132 to which one or more first removable attachment members 116 are attached. The one or more first removable attachment members 116 are configured to be attached to the bathtub adjacent sidewalls 110, shown in FIG. 1. The protective member dispenser 126 has a mechanism 140 for dispensing and retracting the protective member. The protective member 106 has a central axis 122 and a transverse axis 124 that is perpendicular to the central axis. The protective member 106 has a first width defined by the top edge 117 and a bottom edge 134 spaced apart relative to the central axis 122. The protective member 106 has a first length defined by a first side edge 121 and a second side edge 119 extending between the top edge 117 and the bottom edge 134, wherein the first side edge 121 and a second side edge 119 are spaced apart relative to the transverse axis 124, wherein the first side edge 121 is at least partially secured to the protective member dispenser 126. One or more second removable attachment members 118 are located along the second side edge 119 of the protective member 106. The protective member 106 can have one or more third removable attachment members 108, which are located along the bottom edge 134 of the protective member 106. As shown in FIG. 1, during use at least a first upper portion of the protective member 106 comprising the top edge 117 is configured to be situated above a top edge of a water receiving structure 102, thereby preventing water from splashing over the top edge 117 of the water receiving structure 102 and wherein the at least the first upper portion forms a first upper side edge and a second upper side edge. At least a first lower portion of the protective member comprising the bottom edge 134 is configured to extend beyond the open lower edge 130 of the protective member dispenser 126 and be situated inside of the water receiving structure 102 (shown in FIG. 1), thereby allowing water running downwards from the first upper portion to return back to the water receiving structure 102 and wherein the at least the first lower portion forms a first lower side edge and a second lower side edge.

Figure 3:
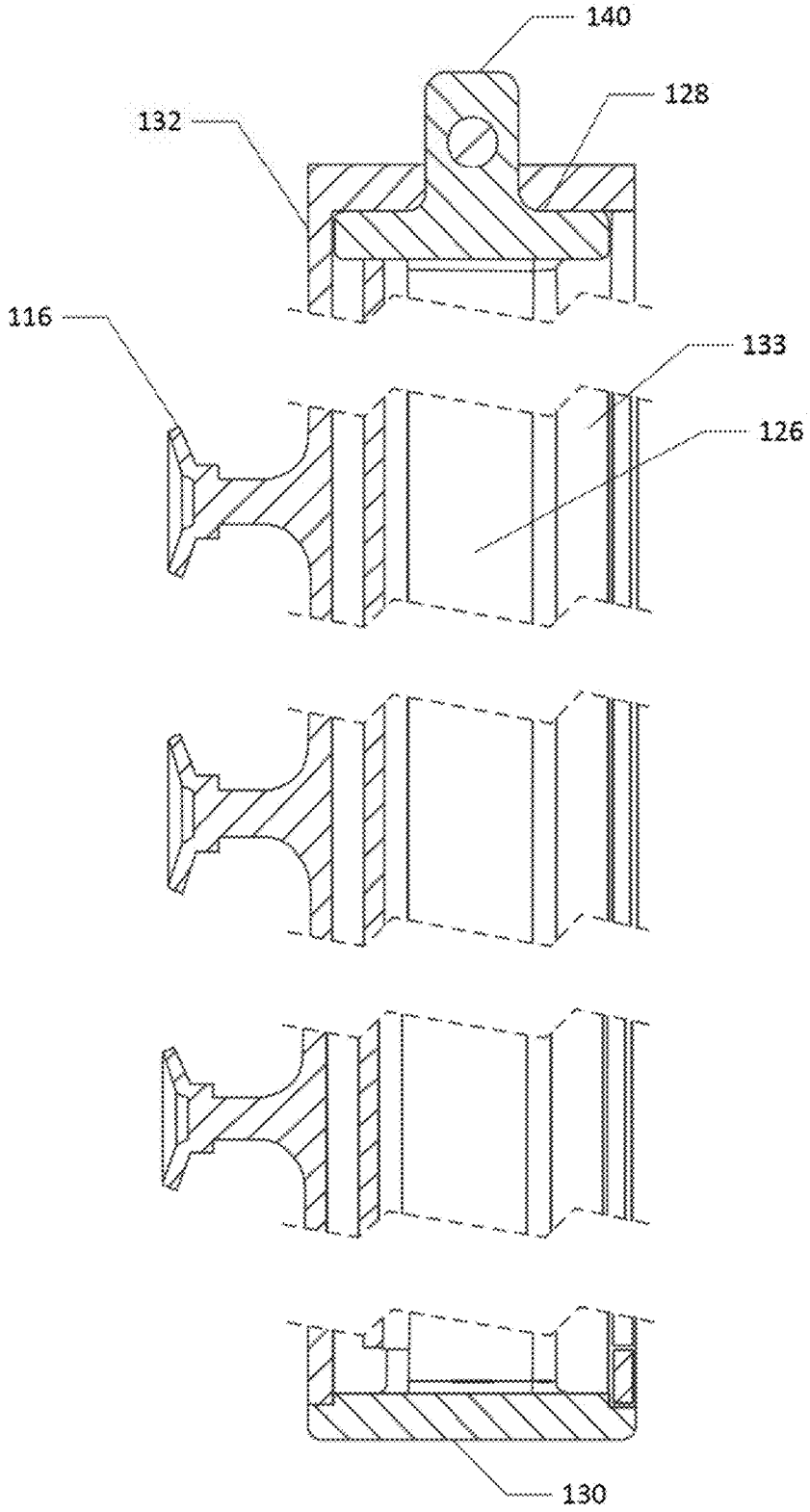
FIG. 3 shows a cross section view of an exemplary article disclosed herein.
Figure 4:
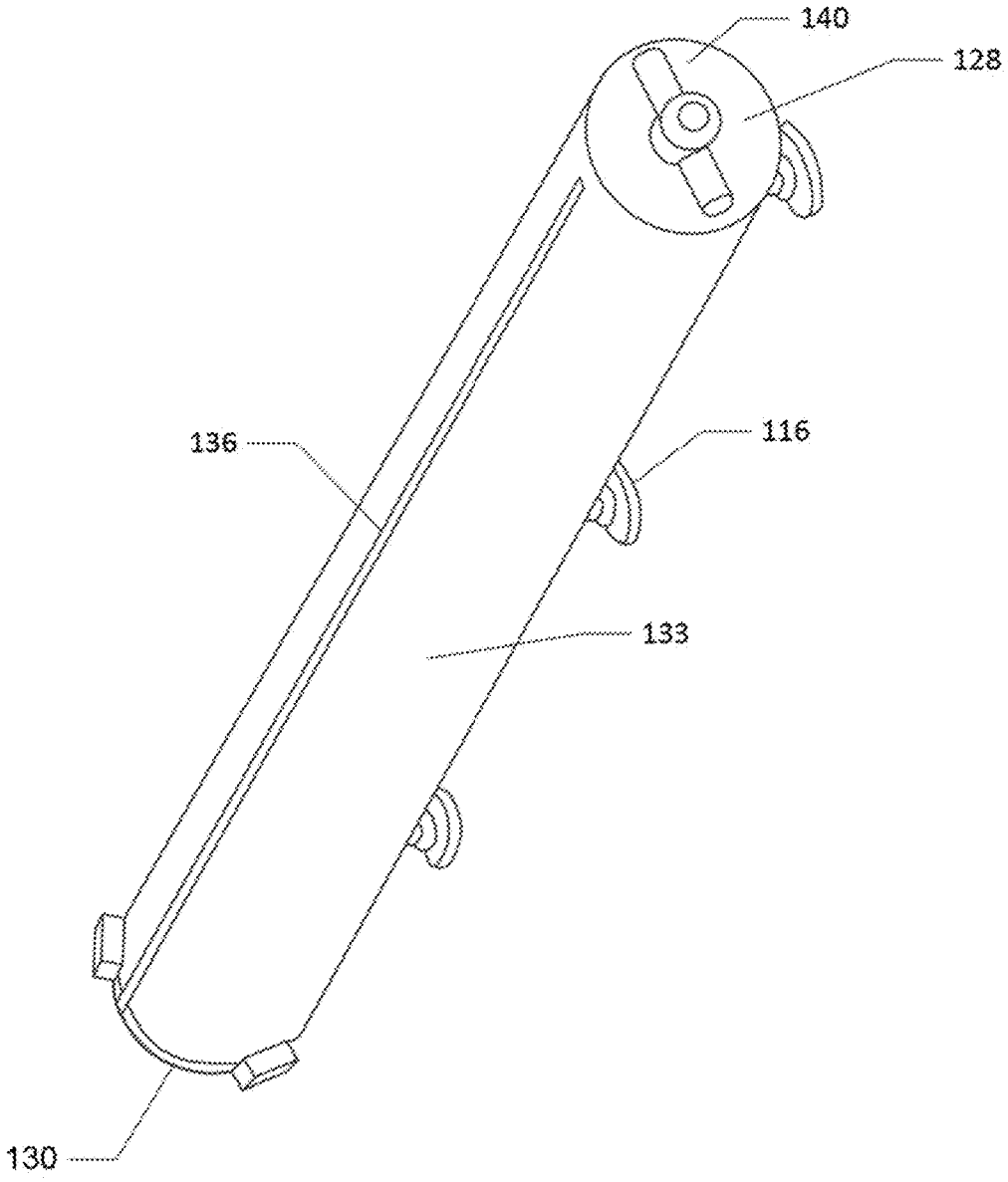
FIG. 4 shows an exemplary article disclosed herein.

FIG. 3 shows a cross sectional view of a protective member dispenser 126 disclosed herein. The protective member dispenser 126 has an upper edge 128 and an open lower edge 130. The protective member dispenser 126 has a side 132 to which one or more first removable attachment members 116 are attached. The protective member dispenser 126 has a protective member housing 133. The protective member housing 133 has a vertical slot 136 that allows for the protective member (not shown) to be dispensed from the protective member dispenser 126. FIG. 4 shows the vertical slot 136.

Figure 5:
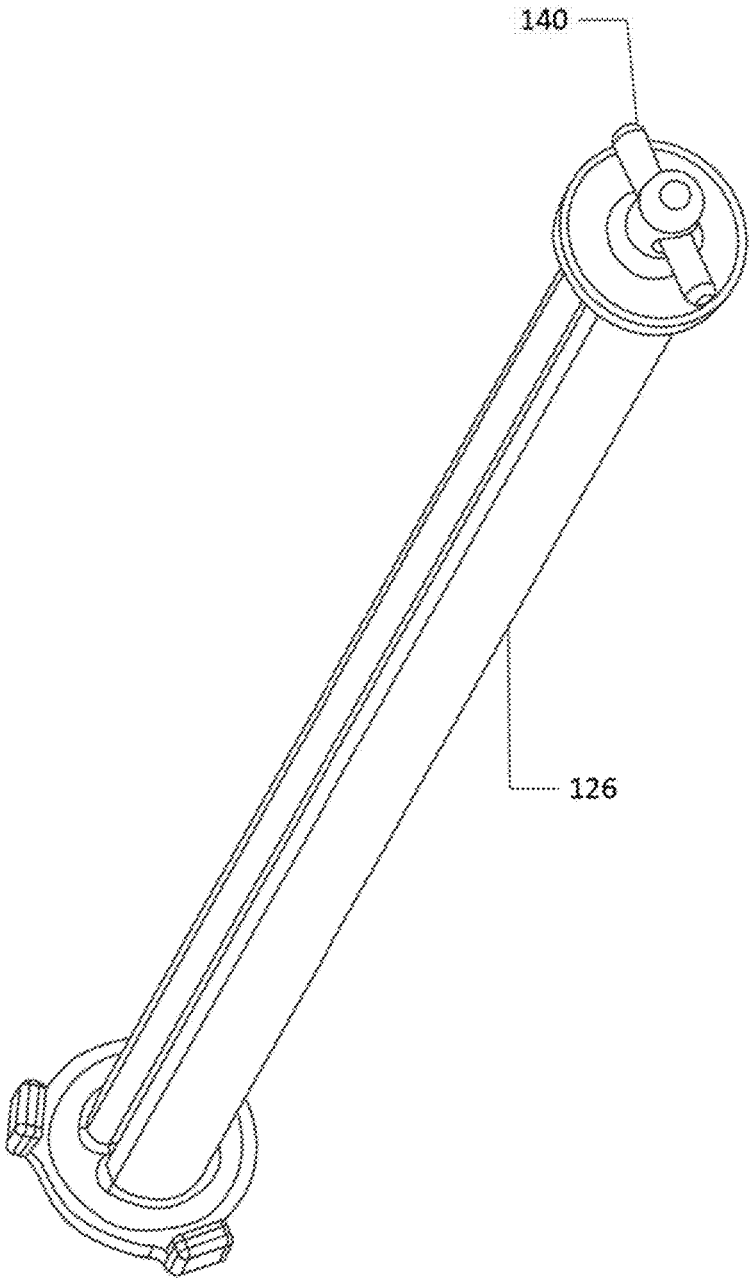
FIG. 5 shows an exemplary article disclosed herein.

FIG. 5 shows a protective member dispenser 126 without a protective member housing. The protective member dispenser 126 has a mechanism 140 for dispensing and retracting the protective member. The mechanism 140 for dispensing and retracting the protective member can be a spring loaded mechanism, which has the ability to automatically retracting a protective member. The mechanism 140 for dispensing and retracting the protective member can also have a lock/release function so that the protective member can be locked at a desired length and only be retracted when desired. For example, the protective member can be dispenses and at a desired length the lock function prevents the protective member from automatically being retracted. The release function, such as, for example, a button, can release the lock function, thereby activating the spring loaded mechanism to allow the protective member to be retracted to the protective member dispenser.

In another aspect, the mechanism 140 for dispensing and retracting the protective member can comprise a manually operable mechanism, such as a hand crank. In such an aspect, the user can manually turn the hand crank to roll up the protective member on the protective member dispenser. The manually operable mechanism, such as a hand crank, can also have a lock/release mechanism so that the protective member can be locked at a desired length and only be retracted manually when desired. The release function, such as, for example, a button, can release the lock function, thereby activating the manually operable mechanism to allow a user to manually retract the protective member to the protective member dispenser.

Figure 6:
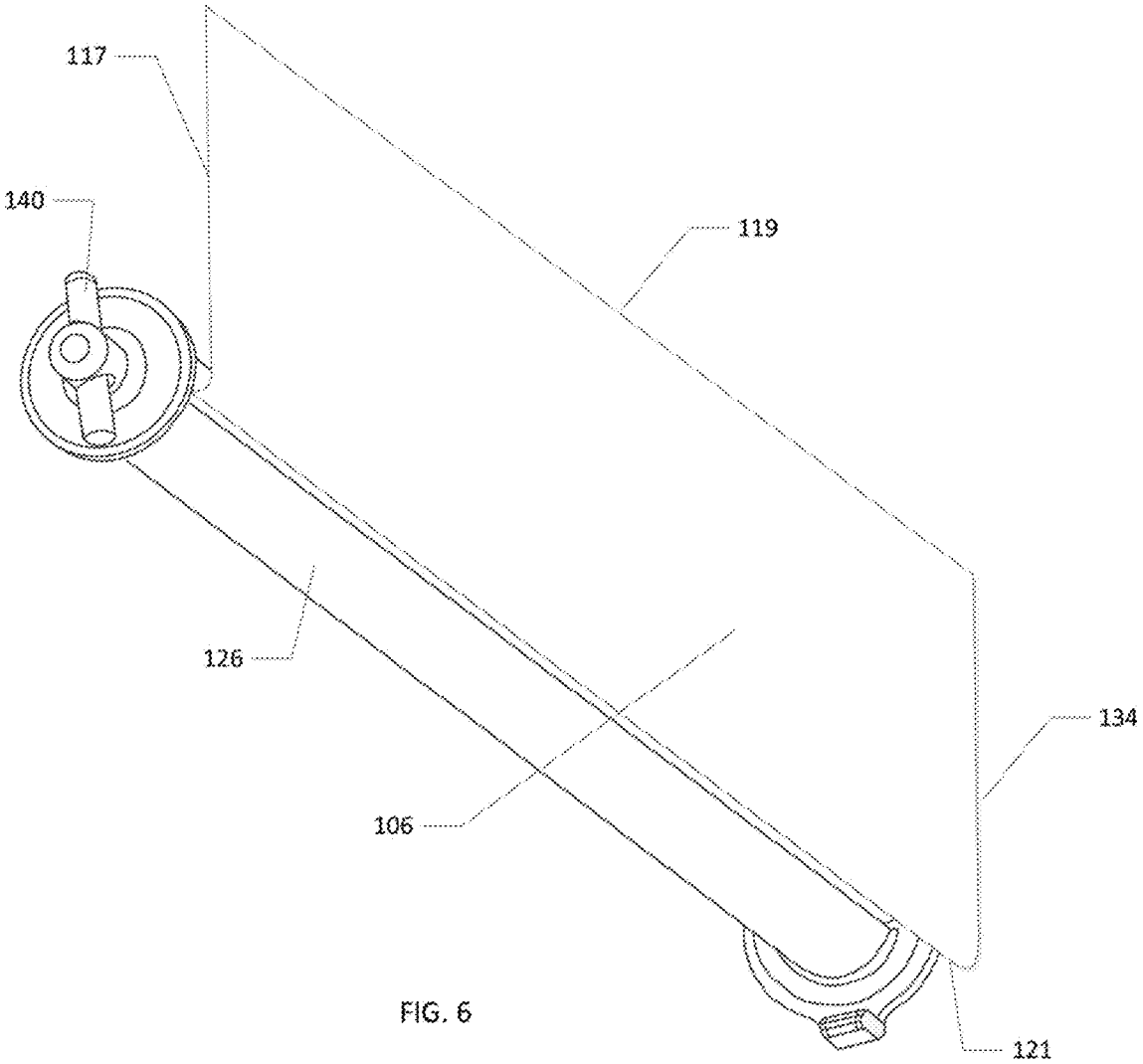
FIG. 6 shows an exemplary article disclosed herein.

FIG. 6 is similar to FIG. 5 but that the protective member 106 is shown where the second side edge 119 is visible. The one or more second removable attachment members are not shown in this view.

Figure 7:
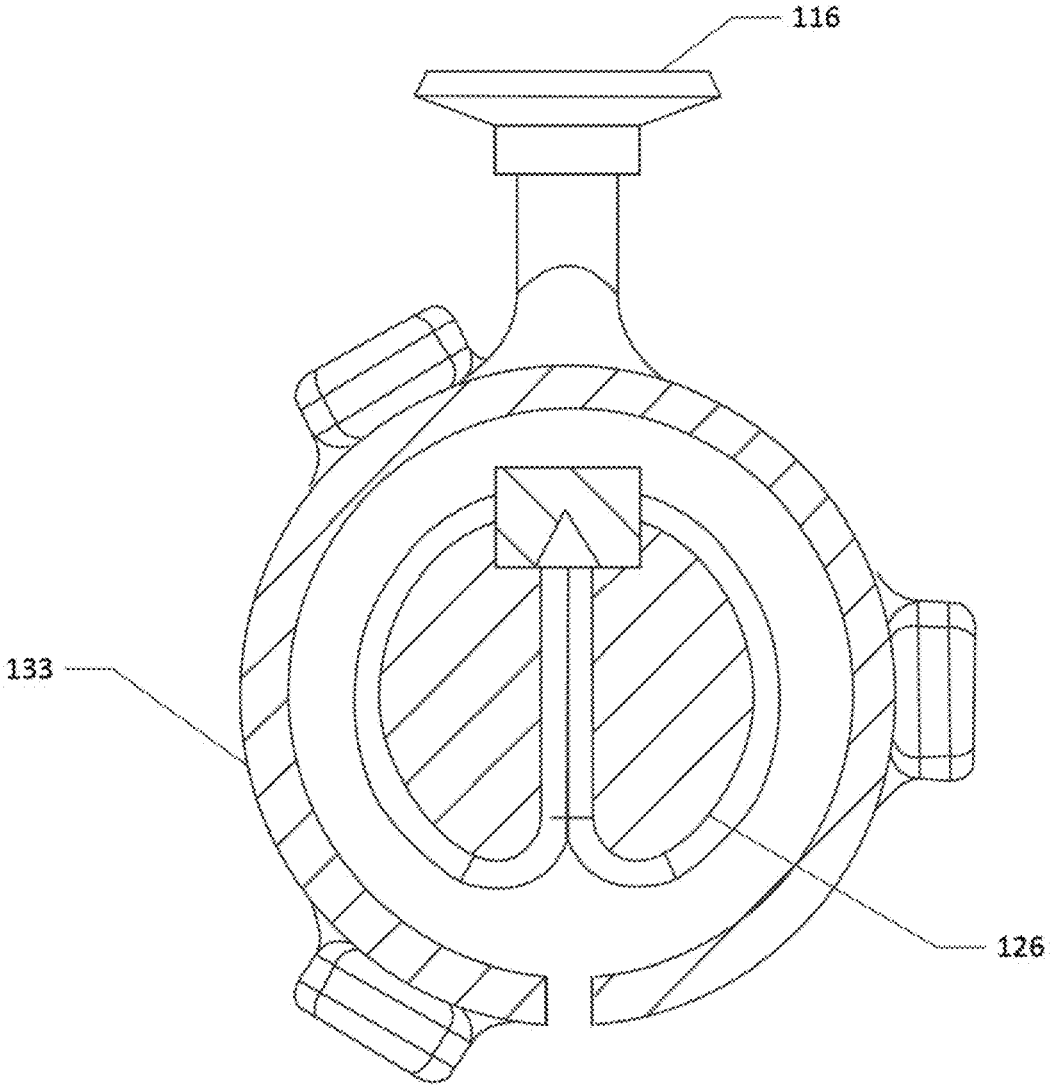
FIG. 7 shows a top view of an exemplary article disclosed herein.

FIG. 7 shows a top view of a protective member dispenser 126 disclosed herein. In this view, the slot of the protective member housing 133 can be seen. Also, the configuration of the one or more first attachment members 116 is shown.

Figure 8:
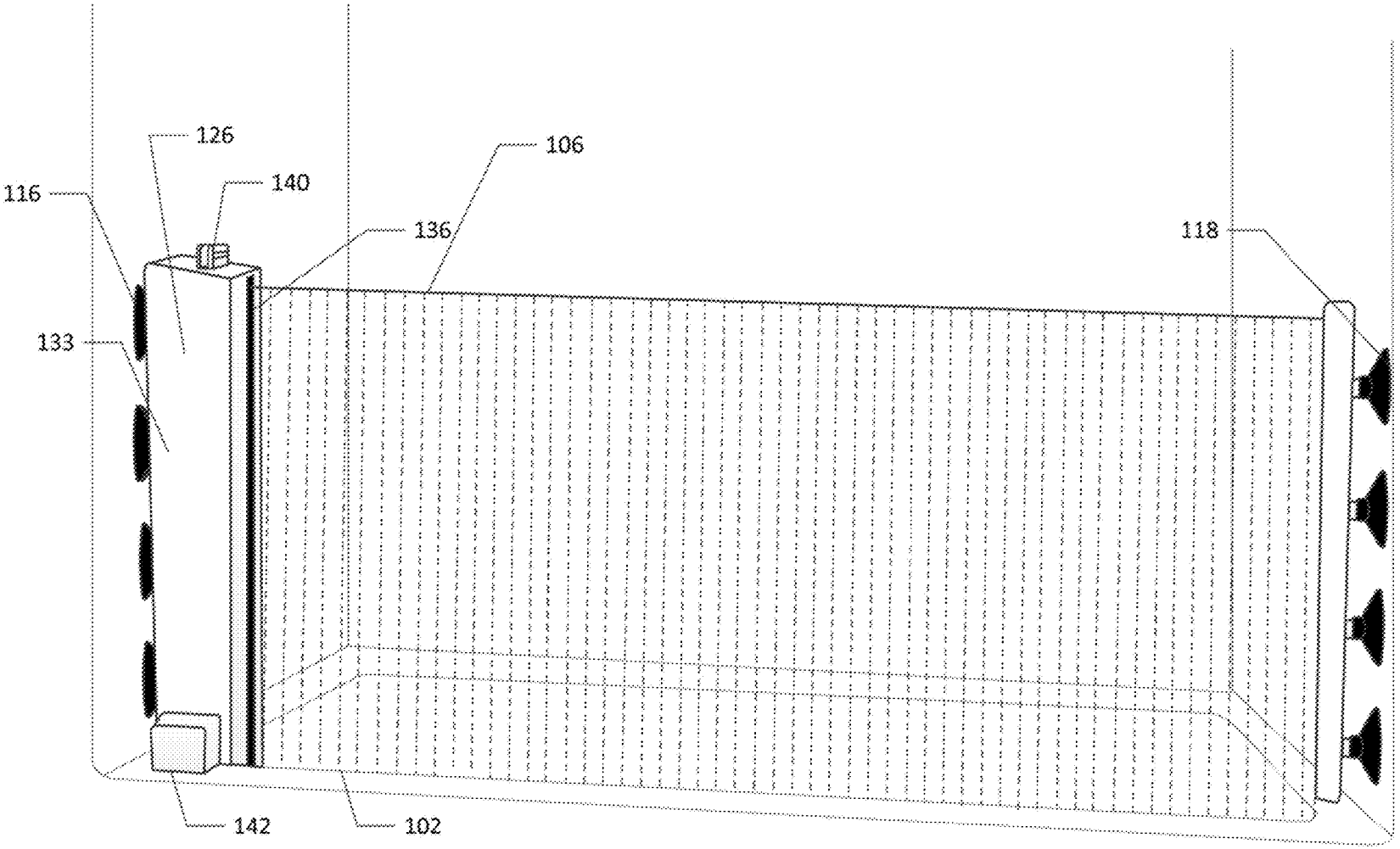
FIG. 8 shows an exemplary article disclosed herein.

FIG. 8 shows a protective member dispenser 126 with a protective member housing 133. The protective member dispenser 126 has a manually operated mechanism 140, in the form of a hand crank, for dispensing and retracting the protective member 106. The protective member housing 133 has a water receiving support structure 142 that is on the top edge of a bathtub 102. The protective member housing 133 has a vertical slot 136 that allows for the protective member (not shown) to be dispensed from the protective member dispenser 126. The one or more first removable attachment members 116 are attached to the bathtub adjacent sidewalls 110, and are also attached to the protective member housing 133 and/or protective member dispenser 126.

Figure 9:
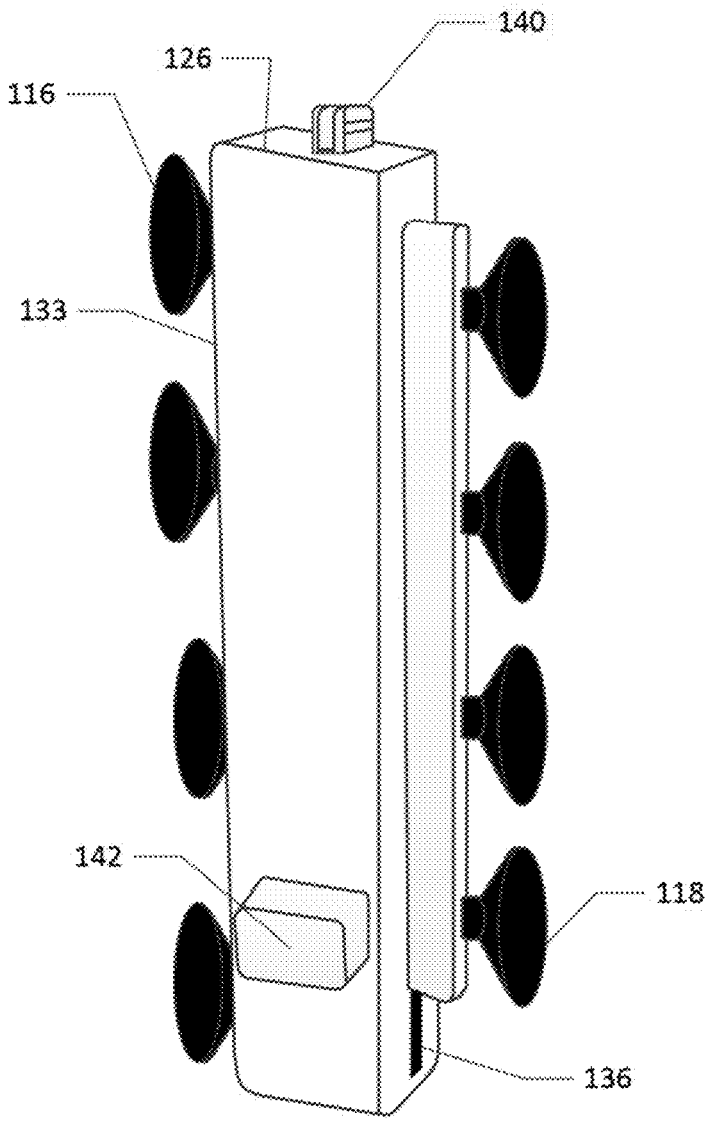
FIG. 9 shows an exemplary article disclosed herein.

FIG. 9 shows a protective member dispenser 126 with a protective member housing 133. The protective member dispenser 126 has a manually operated mechanism 140, in the form of a hand crank, for dispensing and retracting the protective member. The protective member housing 133 has a water receiving support structure 142. The protective member housing 133 has a vertical slot 136 that allows for the protective member (not shown) to be dispensed from the protective member dispenser 126. The one or more first removable attachment members 116 are attached to the protective member housing 133 and/or protective member dispenser 126. The one or more second removable attachment members 118 are also shown.

In some aspects, the inventive article comprising a protective member is susceptible of a low cost manufacture with regards to both materials and labor, and which accordingly susceptible of low prices of sale to the consuming public, thereby making such articles economically available.

C. METHODS

In still further aspects, disclosed herein are the of using the inventive articles comprising a protective member as disclosed above.

in certain aspects, disclosed herein is a method comprising: a) providing an article comprising: i) a protective member comprising: 1) a central axis and a transverse axis that is perpendicular to the central axis, 2) a first width defined by a top edge and a bottom edge spaced apart relative to the central axis, and 3) a first length defined by a first side edge and a second side edge extending between the top edge and the bottom edge, wherein the first side edge and a second side edge are spaced apart relative to the transverse axis; ii) one or more first removable attachment members located along the first side edge; and iii) one or more second removable attachment members located along the second side edge; b) securing the article to allow at least a first upper portion of the protective member comprising the top edge to be situated above a top edge of a water receiving structure, thereby preventing water from splashing over the top edge of the water receiving structure and to allow at least a first lower portion of the protective member comprising the bottom edge to be situated inside of the water receiving structure, thereby allowing water running downwards from the first upper portion to return back to the water receiving structure.

It is understood that the water receiving structure can comprise a shower structure, a tub structure, a pool structure, or any combination thereof. It is further understood that the one or more first, second, third or fourth attachment members can comprise any attachment member that can be removable connect the inventive article to the adjacent surfaces. In some aspects, the attachment members can comprise a suction cap, a water resistant adhesive or any combination thereof. In some exemplary aspects, a user can press the one or more first and second removable attachment members against each of the adjacent to the bathtub side walls and to the inner walls of bathtub if needed. In yet other exemplary aspects, a user can also press the one or more third removable attachment members, if present, along the inside bottom portion of the bathtub to secure the protective member within the bathtub.

With respect to the above description, it is to be realized to that the optimum dimensional relationship for the part of the invention, to include various in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

D. ASPECTS

In view of the described article and method and variations thereof, herein below are described certain more particularly described aspects of the inventions. These particularly recited aspects should not however be interpreted to have any limiting effect on any different claims containing different or more general teachings described herein, or that the "particular" aspects are somehow limited in some way other than the inherent meanings of the language and formulas literally used therein.

Aspect 1: An article comprising: a) a protective member dispenser comprising an upper edge and an open lower edge and a side extending between the upper and lower edge, wherein the protective member dispenser comprises a protective member, which during use is dispensed and comprises: i) a central axis and a transverse axis that is perpendicular to the central axis, ii) a first width defined by a top edge and a bottom edge spaced apart relative to the central axis, iii) a first length defined by a first side edge and a second side edge extending between the top edge and the bottom edge, wherein the first side edge and a second side edge are spaced apart relative to the transverse axis, wherein the first side edge is at least partially secured to the protective member dispenser, b) one or more first removable attachment members attached to the side of the protective member dispenser, c) one or more second removable attachment members located along the second side edge, wherein at least a first upper portion of the protective member comprising the top edge is configured to be situated above a top edge of a water receiving structure, thereby preventing water from splashing over the top edge of the water receiving structure and wherein the at least the first upper portion forms a first upper side edge and a second upper side edge; and wherein at least a first lower portion of the protective member comprising the bottom edge is configured to extend beyond the open lower edge of the protective member dispenser and be situated inside of the water receiving structure, thereby allowing water running downwards from the first upper portion to return back to the water receiving structure and wherein the at least the first lower portion forms a first lower side edge and a second lower side edge.

Aspect 2: The article of aspect 1, wherein the protective member dispenser comprises a mechanism for dispensing and retracting the protective member.

Aspect 3: The article of aspect 2, wherein the mechanism for dispensing and retracting the protective member comprises a spring loaded mechanism.

Aspect 4: The article of aspect 2, wherein the mechanism for dispensing and retracting the protective member comprises a manually operable mechanism.

Aspect 5: The article of aspect 2, wherein the mechanism for dispensing and retracting the protective member is configured to secure the protective member at a desired length.

Aspect 6: The article of any one of aspects 1-5, wherein the protective member further comprises one or more third removable attachment members located along the bottom edge of the protective member.

Aspect 7: The article of any one of aspects 1-6, wherein the protective member extends from about 1 to about 15 inches beyond the open lower edge of the protective member dispenser.

Aspect 8: The article of any one of aspects 1-7, wherein the protective member extends from about 2 to about 6 inches beyond the open lower edge of the protective member dispenser.

Aspect 9: The article of any one of aspects 1-8, wherein the upper edge of the protective member dispenser is at least partially open.

Aspect 10: The article of any one of aspects 1-9, wherein the protective member dispenser further comprises a protective member housing.

Aspect 11: The article of any one of aspects 1-10, wherein the water receiving structure comprises a shower structure, a tub structure, a pool structure, or any combination thereof.

Aspect 12: The article of any one of aspects 1-11, wherein the one or more first or second removable attachment members comprise a suction cup.

Aspect 13: The article of any one of aspects 1-12, wherein the first width is from about 10 inches to about 60 inches.

Aspect 14: The article of any one of aspects 1-12, wherein the first width is from about 15 inches to about 40 inches.

Aspect 15: The article of any one of aspects 1-14, wherein the protective member is transparent.

Aspect 16: The article of any one of aspects 1-15, wherein the first length is from about 40 inches to about 80 inches.

Aspect 17: The article of any one of aspects 1-16, wherein the first length is from about 55 inches to about 70 inches.

Aspect 18: The article of any one of aspects 1-17, wherein the protective member is a plastic material.

Aspect 19: The article of any one of aspects 1-18, wherein the one or more first removable attachment members comprises at least three or more first removable attachment members, and wherein the one or more second removable attachment members comprises at least three or more second removable attachment members.

Aspect 20: The article of any one of aspects 1-19, wherein the article further comprises a water removal structure that is configured to remove water from the protective member when the protective member is retracted to the protective member dispenser after use.

Aspect 21: A method comprising the step of securing the article of any one of aspects 1-20 to a water receiving structure by attaching the one or more first removable attachment members to the water receiving structure and attaching the one or more second removable attachment members to the water receiving structure such that the protective member comprising the top edge to be situated above a top edge of the water receiving structure, thereby preventing water from splashing over the top edge of the water receiving structure and to allow at least a first lower portion of the protective member comprising the bottom edge to be situated inside of the water receiving structure, thereby allowing water running downwards from the first upper portion to return back to the water receiving structure.

Aspect 22: An article comprising: a) a protective member dispenser comprising an upper edge and an open lower edge and a side extending between the upper and lower edge, wherein the protective member dispenser comprises a first support bar being parallel to the side of the protective member dispenser extending between the upper and lower edge, wherein the protective member dispenser comprises a protective member, which during use is dispensed and comprises: i) a central axis and a transverse axis that is perpendicular to the central axis, ii) a first width defined by a top edge and a bottom edge spaced apart relative to the central axis, iii) a first length defined by a first side edge and a second side edge extending between the top edge and the bottom edge, wherein the first side edge and a second side edge are spaced apart relative to the transverse axis, wherein the first side edge is at least partially secured to the protective member dispenser, b) one or more first removable attachment members attached to the first support bar, c) one or more second removable attachment members located along the second side edge or one or more second removable attachment members attached to a second support bar secured to the second side edge, wherein at least a first upper portion of the protective member comprising the top edge is configured to be situated above a top edge of a water receiving structure, thereby preventing water from splashing over the top edge of the water receiving structure and wherein the at least the first upper portion forms a first upper side edge and a second upper side edge; and wherein at least a first lower portion of the protective member comprising the bottom edge is configured to extend beyond the open lower edge of the protective member dispenser and be situated inside of the water receiving structure, thereby allowing water running downwards from the first upper portion to return back to the water receiving structure and wherein the at least the first lower portion forms a first lower side edge and a second lower side edge.

Aspect 23: The article of aspect 22, wherein the one or more first removable attachment members are attached to a bottom edge of the first support bar.

Aspect 24: The article of aspect 23, wherein the second support bar is secured to the second side edge and wherein the one or more second removable attachment members are attached to a bottom edge of the second support bar.

Aspect 25: An article comprising: a) a protective member comprising: i) a central axis and a transverse axis that is perpendicular to the central axis, ii) a first width defined by a top edge and a bottom edge spaced apart relative to the central axis, iii) a first length defined by a first side edge and a second side edge extending between the top edge and the bottom edge, wherein the first side edge and a second side edge are spaced apart relative to the transverse axis, b) one or more first removable attachment members located along the first side edge, c) one or more second removable attachment members located along the second side edge, wherein at least a first upper portion of the protective member comprising the top edge is configured to be situated above a top edge of a water receiving structure, thereby preventing water from splashing over the top edge of the water receiving structure and wherein the at least the first upper portion forms a first upper side edge and a second upper side edge; and wherein at least a first lower portion of the protective member comprising the bottom edge is configured to be situated inside of the water receiving structure, thereby allowing water running downwards from the first upper portion to return back to the water receiving structure and wherein the at least the first lower portion forms a first lower side edge and a second lower side edge.

Aspect 26: The article of aspect 25, wherein the water receiving structure comprises a shower structure, a tub structure, a pool structure, or any combination thereof.

Aspect 27: The article of aspect 25 or 26, wherein the at least the first upper portion of the protective member has a second width.

Aspect 28: The article of any one of aspects 25-27, wherein the at least the first lower portion of the protective member has a third width.

Aspect 29: The article of any one of aspects 25-28, wherein the second and third width are the same or different.

Aspect 30: The article of any one of aspects 25-29, wherein the second width is from about 1 to about 40 inches.

Aspect 31: The article of any one of aspects 25-30, wherein the third width is from about 1 to about 40 inches.

Aspect 32: The article of any one of aspects 25-31, wherein the one or more first and/or second removable attachment members are located along the first and second upper side edges.

Aspect 33: The article of any one of aspects 25-32, wherein the water receiving structure is a shower structure and wherein the top edge of the water receiving structure is a bottom rim of the shower structure.

Aspect 34: The article of any one of aspects 25-32, wherein the water receiving structure is a tub and wherein the top edge of the water receiving structure is a tub rim.

Aspect 35: The article of any one of aspects 25-34, wherein the water receiving structure is a pool and wherein the top edge of the water receiving structure is a pool rim.

Aspect 36: The article of any one of aspects 25-35, wherein the one or more first and second removable attachment members are located along the first and second side edge of the protective member and are configured to be attached to adjacent side walls of the water receiving structure.

Aspect 37: The article of any one of aspects 25-36, wherein the protective member further comprises one or more third removable attachment members located along the bottom edge of the protective member.

Aspect 38: The article of aspect 37, wherein the one or more third removable attachment members placed along the bottom edge of the protective member is attached to an adjacent part of the water receiving structure.

Aspect 39: The article of aspect 38, wherein the water receiving structure is a tub or a pool, the adjacent part of the water receiving structure is a sidewall of the tub or the pool.

Aspect 40: The article of any one of aspects 25-39, wherein the protective member can further comprise one or more fourth removable attachment members located on the protective member.

Aspect 41: The article of any one of aspects 25-40, wherein the one or more first, second, third and fourth removable attachment members are a same type of an attachment member or a different type of an attachment member.

Aspect 42: The article of aspect 41, wherein the one or more first, second, third or fourth removable attachment members comprise a suction cup.

Aspect 43: The article of aspect 42, wherein the one or more first, second, third or fourth removable attachment member comprises a water resistant adhesive.

Aspect 44: The article of any one of aspects 25-43, wherein the protective member is a plastic material.

Aspect 45: The article of aspect 44, wherein the protective member is a foldable plastic.

Aspect 46: The article of aspect 45, wherein the plastic material comprises vinyl.

Aspect 47: The article of any one of aspects 25-46, wherein the protective member is transparent.

Aspect 48: The article of any one of aspects 25-47, wherein the protective member comprises a decorative pattern.

Aspect 49: The article of any one of aspects 25-48, wherein the protective member is colored.

Aspect 50: The article of any one of aspects 25-49, wherein the first length of the protective member is configured to extend to a second length, wherein the second length corresponds to a distance between the adjacent sidewalls of the water receiving structure.

Aspect 51: The article of any one of aspects 25-50, wherein the first length of the protective member is configured to contract to a third length, wherein the third length corresponds to a distance between the adjacent sidewalls of the water receiving structure.

Aspect 52: The article of aspects 50 or 51, wherein the second length is different from the third length.

Aspect 53: The article of any one of aspects 25-52, wherein the top edge of the protective member comprises a first extension member allowing to extend the first length to the second length and/or to contract the first length to the third length.

Aspect 54: The article of any one of aspects 25-54, wherein the bottom edge of the protective member comprises a second extension member allowing to extend the first length to the second length and/or contract the first length to the third length.

Aspect 55: The article of aspects 53 or 54, wherein the first and second extension members are a same type extension member or a different type extension member.

Aspect 56: The article aspect 55, wherein the extension member comprises an elastic material.

Aspect 57: The article of any one of aspects 25-56, wherein at least a third portion of the protective member is folded relative to the transverse axis to form a folded structure having a fourth length.

Aspect 58: The article of aspect 57, wherein the folded structure is attached to at least a fourth portion of the protective member having a fifth length with one or more fifth attachment members.

Aspect 59: The article of aspect 58, wherein the one or more of fifth attachment members are located on the folded structure and on the at least a fourth portion of the protective member.

Aspect 60: The article of any one of aspects 57-59, wherein the folded structure allows extending the protective member by the fourth length when unfolded.

Aspect 61: The article of any one of aspects 58-60, wherein the one or more of fifth attachment members comprise a fastener.

Aspect 62: The article of aspect 61, wherein the fastener comprises a snapping fastener, a locking fastener, an adhesive fastener, or any combination thereof.

Aspect 63: The article of aspect 61 or 62, wherein the fastener comprises a female and a male member.

Aspect 64: A method comprising: a) providing an article comprising: i) protective member comprising: 1) a central axis and a transverse axis that is perpendicular to the central axis, 2) a first width defined by a top edge and a bottom edge spaced apart relative to the central axis, 3) a first length defined by a first side edge and a second side edge extending between the top edge and the bottom edge, wherein the first side edge and a second side edge are spaced apart relative to the transverse axis, ii) one or more first removable attachment members located along the first side edge, iii) one or more second removable attachment members located along the second side edge, b) securing the article to allow at least a first upper portion of the protective member comprising the top edge to be situated above a top edge of a water receiving structure, thereby preventing water from splashing over the top edge of the water receiving structure and to allow at least a first lower portion of the protective member comprising the bottom edge to be situated inside of the water receiving structure, thereby allowing water running downwards from the first upper portion to return back to the water receiving structure.

Aspect 65: The method of aspect 64, wherein the water receiving structure comprises a shower structure, a tub structure, a pool structure, or any combination thereof.

Aspect 66: The method of aspect 64 or 65, wherein the at least the first upper portion of the protective member has a second width.

Aspect 67: The method of any one of aspects 64-66, wherein the at least the first lower portion of the protective member has a third width.

Aspect 68: The method any one of aspects 64-67, wherein the second and third width are the same or different.

Aspect 69: The method of any one of aspects 64-68, wherein the second width is from about 1 to about 40 inches.

Aspect 70: The method of any one of aspects 64-69, wherein the third width is from about 1 to about 40 inches.

Aspect 71: The method of any one of aspects 64-70, wherein the water receiving structure is a shower structure and wherein the top edge of the water receiving structure is a bottom rim of the shower structure.

Aspect 72: The method of any one of aspects 64-71, wherein the water receiving structure is a tub and wherein the top edge of the water receiving structure is a tub rim.

Aspect 73: The method of any one of aspects 64-72, wherein the water receiving structure is a pool and wherein the top edge of the water receiving structure is a pool rim.

Aspect 74: The method of any one of aspects 64-73, wherein the one or more first and second removable attachment members are located along the first and second side edge of the protective member and are configured to be attached to adjacent side walls of the water receiving structure.

Aspect 75: The method of any one of aspects 64-74, wherein the protective member further comprises one or more third removable attachment members located along the bottom edge of the protective member.

Aspect 76: The method of aspect 75, wherein the one or more third removable attachment members placed along the bottom edge of the protective member is attached to an adjacent part of the water receiving structure.

Aspect 77: The method of aspect 76, wherein the water receiving structure is a tub or a pool, the adjacent part of the water receiving structure is a sidewall of the tub or the pool.

Aspect 78: The method of any one of aspects 64-77, wherein the protective member can further comprise one or more fourth removable attachment members located on the protective member.

Aspect 79: The method of any one of aspects 64-78, wherein the one or more first, second, third and fourth removable attachment members are a same type of an attachment member or a different type of an attachment member.

Aspect 80: The method of aspect 79, wherein the one or more first, second, third or fourth removable attachment members comprise a suction cup.

Aspect 81: The method of aspect 80, wherein the one or more first, second, third or fourth removable attachment member comprises a water resistant adhesive.

Aspect 82: The method of any one of aspects 64-81, wherein the protective member is a plastic material.

Aspect 83: The method of aspect 82, wherein the protective member is a foldable plastic.

Aspect 84: The method of aspect 83, wherein the plastic material comprises vinyl.

Aspect 85: The method of any one of aspects 64-84, wherein the protective member is transparent.

Aspect 86: The method of any one of aspects 64-85, wherein the protective member comprises a decorative pattern.

Aspect 87: The method of any one of aspects 64-86, wherein the protective member is colored.

Aspect 88: The method of any one of aspects 64-88, wherein the first length of the protective member is configured to extend to a second length, wherein the second length corresponds to a distance between the adjacent sidewalls of the water receiving structure.

Aspect 89: The method of any one of aspects 64-89, wherein the first length of the protective member is configured to contract to a third length, wherein the third length corresponds to a distance between the adjacent sidewalls of the water receiving structure.

Aspect 90: The method of aspects 88 or 89, wherein the second length is different from the third length.

Aspect 91: The method of any one of aspects 64-90, wherein the top edge of the protective member comprises a first extension member allowing to extend the first length to the second length and/or to contract the first length to the third length.

Aspect 92: The method of any one of aspects 64-92, wherein the bottom edge of the protective member comprises a second extension member allowing to extend the first length to the second length and/or contract the first length to the third length.

Aspect 93: The method of aspects 91 or 92, wherein the first and second extension members are a same type extension member or a different type extension member.

Aspect 94: The method aspect 93, wherein the extension member comprises an elastic material.

Aspect 95: The method of any one of aspects 64-94, wherein at least a third portion of the protective member is folded relative to the transverse axis to form a folded structure having a fourth length.

Aspect 96: The method of aspect 95, wherein the folded structure is attached to at least a fourth portion of the protective member having a fifth length with one or more fifth attachment members.

Aspect 97: The method of aspect 96, wherein the one or more of fifth attachment members are located on the folded structure and on the at least a fourth portion of the protective member.

Aspect 98: The method of any one of aspects 95-97, wherein the folded structure allows extending the protective member by the fourth length when unfolded.

Aspect 99: The method of any one of aspects 64-98, wherein the one or more of fifth attachment members comprise a fastener.

Aspect 100: The method of aspect 99, wherein the fastener comprises a snapping fastener, a locking fastener, an adhesive fastener, or any combination thereof.

Aspect 101: The method of aspect 99 or 100, wherein the fastener comprises a female and a male member.

What is claimed is:

1. An article comprising:

a) a protective member dispenser comprising an upper edge and an open lower edge and a side extending between the upper and lower edge, wherein the protective member dispenser comprises a protective member, which during use is dispensed and comprises:

i. a central axis and a transverse axis that is perpendicular to the central axis, ii. a first width defined by a top edge and a bottom edge spaced apart relative to the central axis, iii. a first length defined by a first side edge and a second side edge extending between the top edge and the bottom edge, wherein the first side edge and a second side edge are spaced apart relative to the transverse axis, wherein the first side edge is at least partially secured to the protective member dispenser, b) one or more first removable attachment members attached to the side of the protective member dispenser, c) one or more second removable attachment members located along the second side edge, wherein at least a first upper portion of the protective member comprising the top edge is configured to be situated above a top edge of a water receiving structure, thereby preventing water from splashing over the top edge of the water receiving structure and wherein the at least the first upper portion forms a first upper side edge and a second upper side edge; and wherein at least a first lower portion of the protective member comprising the bottom edge is configured to extend beyond the open lower edge of the protective member dispenser and be situated inside of the water receiving structure, thereby allowing water running downwards from the first upper portion to return back to the water receiving structure and wherein the at least the first lower portion forms a first lower side edge and a second lower side edge.

2. The article of claim 1, wherein the protective member dispenser comprises a mechanism for dispensing and retracting the protective member.

3. The article of claim 2, wherein the mechanism for dispensing and retracting the protective member comprises a spring loaded mechanism.

4. The article of claim 2, wherein the mechanism for dispensing and retracting the protective member comprises a manually operable mechanism.

5. The article of claim 2, wherein the mechanism for dispensing and retracting the protective member is configured to secure the protective member at a desired length.

6. The article of claim 1, wherein the protective member further comprises one or more third removable attachment members located along the bottom edge of the protective member.

7. The article of claim 1, wherein the protective member extends from about 1 to about 15 inches beyond the open lower edge of the protective member dispenser.

8. The article of claim 1, wherein the upper edge of the protective member dispenser is at least partially open.

9. The article of claim 1, wherein the protective member dispenser further comprises a protective member housing.

10. The article of claim 1, wherein the water receiving structure comprises a shower structure, a tub structure, a pool structure, or any combination thereof.

11. The article of claim 1, wherein the one or more first or second removable attachment members comprise a suction cup.

12. The article of claim 1, wherein the first width is from about 10 inches to about 60 inches.

13. The article of claim 1, wherein the protective member is transparent.

14. The article of claim 1, wherein the first length is from about 40 inches to about 80 inches.

15. The article of claim 1, wherein the one or more first removable attachment members comprises at least three or more first removable attachment members, and wherein the one or more second removable attachment members comprises at least three or more second removable attachment members.

16. The article of claim 1, wherein the article further comprises a water removal structure that is configured to remove water from the protective member when the protective member is retracted to the protective member dispenser after use.

17. A method comprising the step of securing the article of claim 1 to a water receiving structure by attaching the one or more first removable attachment members to the water receiving structure and attaching the one or more second removable attachment members to the water receiving structure such that the protective member comprising the top edge to be situated above a top edge of the water receiving structure, thereby preventing water from splashing over the top edge of the water receiving structure and to allow at least a first lower portion of the protective member comprising the bottom edge to be situated inside of the water receiving structure, thereby allowing water running downwards from the first upper portion to return back to the water receiving structure.

18. An article comprising:

a) a protective member dispenser comprising an upper edge and an open lower edge and a side extending between the upper and lower edge, wherein the protective member dispenser comprises a first support bar being parallel to the side of the protective member dispenser extending between the upper and lower edge, wherein the protective member dispenser comprises a protective member, which during use is dispensed and comprises:

i. a central axis and a transverse axis that is perpendicular to the central axis, ii. a first width defined by a top edge and a bottom edge spaced apart relative to the central axis, iii. a first length defined by a first side edge and a second side edge extending between the top edge and the bottom edge, wherein the first side edge and a second side edge are spaced apart relative to the transverse axis, wherein the first side edge is at least partially secured to the protective member dispenser, b) one or more first removable attachment members attached to the first support bar, c) one or more second removable attachment members located along the second side edge or one or more second removable attachment members attached to a second support bar secured to the second side edge, wherein at least a first upper portion of the protective member comprising the top edge is configured to be situated above a top edge of a water receiving structure, thereby preventing water from splashing over the top edge of the water receiving structure and wherein the at least the first upper portion forms a first upper side edge and a second upper side edge; and wherein at least a first lower portion of the protective member comprising the bottom edge is configured to extend beyond the open lower edge of the protective member dispenser and be situated inside of the water receiving structure, thereby allowing water running downwards from the first upper portion to return back to the water receiving structure and wherein the at least the first lower portion forms a first lower side edge and a second lower side edge.

19. The article of claim 18, wherein the one or more first removable attachment members are attached to a bottom edge of the first support bar.

20. The article of claim 19, wherein the second support bar is secured to the second side edge and wherein the one or more second removable attachment members are attached to a bottom edge of the second support bar.

* * * * *